US011338963B2

(12) United States Patent
Caszatt et al.

(10) Patent No.: US 11,338,963 B2
(45) Date of Patent: May 24, 2022

(54) TETHERED CONTAINER CLOSURE

(71) Applicant: BERICAP, INC., Burlington (CA)

(72) Inventors: Bradley W. Caszatt, Manchester, MI (US); Bradley Wilson, Manchester, MI (US)

(73) Assignee: Bericap, Inc.

( * ) Notice: Subject to any disclaimer, the term of this patent is extended or adjusted under 35 U.S.C. 154(b) by 0 days.

(21) Appl. No.: 16/980,948

(22) PCT Filed: Mar. 15, 2018

(86) PCT No.: PCT/US2018/022704
§ 371 (c)(1),
(2) Date: Sep. 15, 2020

(87) PCT Pub. No.: WO2019/177616
PCT Pub. Date: Sep. 19, 2019

(65) Prior Publication Data

US 2020/0407124 A1 Dec. 31, 2020

(51) Int. Cl.
*B65D 41/34* (2006.01)
*B65D 50/06* (2006.01)
*B65D 51/24* (2006.01)

(52) U.S. Cl.
CPC ..... *B65D 41/3428* (2013.01); *B65D 50/061* (2013.01); *B65D 51/245* (2013.01)

(58) Field of Classification Search
CPC ..... B65D 1/0246; B65D 1/0245; B65D 41/3409; B65D 41/3428; B65D 41/3447; B65D 50/061
See application file for complete search history.

(56) References Cited

U.S. PATENT DOCUMENTS 3,904,062 A * 9/1975 Grussen ..... B65D 41/3447 215/252
5,056,675 A * 10/1991 Julian ..... B65D 41/3409 215/252
5,215,204 A * 6/1993 Beck ..... B65D 41/3447 215/252
5,676,269 A 10/1997 Blake et al.
6,360,909 B1 3/2002 Bridge
6,474,491 B1 11/2002 Benoit-Gonin et al.
6,622,882 B2 9/2003 Smith
7,303,088 B2 * 12/2007 Sawyer ..... B65D 47/0809 215/237
8,413,832 B2 4/2013 Mazurkiewicz et al.
8,474,646 B2 * 7/2013 Danks ..... B65D 47/0838 220/361
8,584,875 B2 11/2013 Clodfelter et al.
9,321,567 B2 4/2016 Daggett et al.
(Continued)

FOREIGN PATENT DOCUMENTS

EP 3135600 A1 3/2017
KR 100942642 B1 7/2010
(Continued)

*Primary Examiner* — Shawn M Braden
(74) *Attorney, Agent, or Firm* — Luke A. Mast

(57) ABSTRACT

A closure for closing an opening defined by a finish of a container. The closure includes a main body and a tamper band. The tamper band is connected to the main body by a plurality of bridges. A hinge of the closure is configured to permit the main body to pivot relative to the tamper band.

19 Claims, 9 Drawing Sheets

(56) References Cited

U.S. PATENT DOCUMENTS

Figure 1:
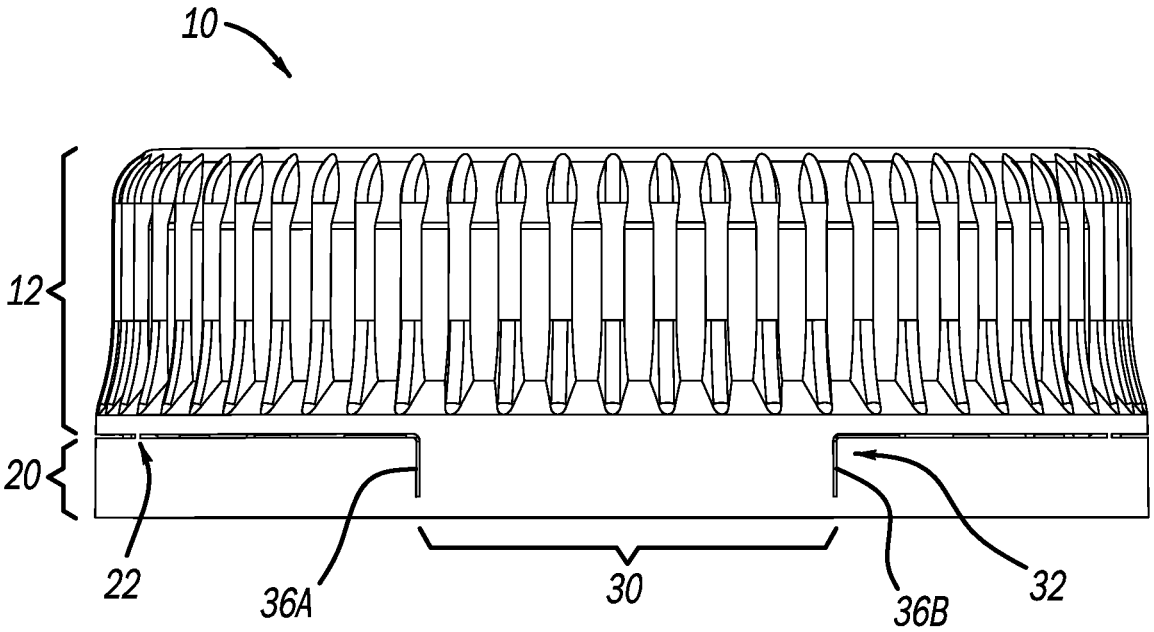

| | | | | |
|---|---|---|---|---|
| 2008/0047976 | A1 | 2/2008 | Scheer et al. | |
| 2009/0050648 | A1 | 2/2009 | Wisniewski | |
| 2011/0174760 | A1* | 7/2011 | Luzzato | B65D 41/48 215/252 |
| 2012/0024815 | A1* | 2/2012 | Kwon | B65D 55/16 215/272 |
| 2014/0263339 | A1* | 9/2014 | Bates | B65D 41/0464 220/296 |
| 2015/0129531 | A1* | 5/2015 | Gatto | B65D 50/061 215/201 |
| 2015/0251827 | A1 | 9/2015 | Campbell | |

FOREIGN PATENT DOCUMENTS

| | | | | |
|---|---|---|---|---|
| WO | 1996029257 | A1 | 9/1996 | |
| WO | 1998057864 | A1 | 12/1998 | |
| WO | 2002028735 | A1 | 4/2002 | |
| WO | 2003016162 | A1 | 2/2003 | |
| WO | 2006099214 | A2 | 9/2006 | |
| WO | WO-2009048273 | A2 * | 4/2009 | B65D 41/3409 |

* cited by examiner

TETHERED CONTAINER CLOSURE

FIELD

The present disclosure relates to a tethered closure for a container.

BACKGROUND

This section provides background information related to the present disclosure, which is not necessarily prior art.

Typical container closures include a main closure body, and a detachable lower portion called a tamper band. The tamper band is loosely held by the main body by small bridges formed during injection molding of the closure. Alternatively, the bridges may be formed by scoring a solid closure around the circumference thereof, except at the bridge areas. The bridges allow the tamper band to be frangible. When the closure is applied to a container finish after the container has been filled, the closure slips over a mating feature known as a tamper bead. When the closure is removed, small tamper clips on an inside of the closure engage a bottom surface of the tamper bead to prevent the tamper band from being removed from the container finish, thereby causing the tamper bridges to break and separate from the main body of the closure as the closure is being unscrewed from the container finish. This separation serves as a visual reference indicating whether the container has been previously opened or tampered with.

While current container closures are suitable for their intended use, they are subject to improvement. The present disclosure advantageously includes an improved container closure that indicates tamper evidence, and simultaneously retains the closure to the finish after the closure has been turned a predetermined distance so that the closure can flip upward at a hinge to allow access to a commodity stored within the container. The closure can then be rotated back downward upon the opening of the container and re-screwed onto the container finish to reseal the container. The present disclosure provides numerous additional advantages and unexpected results, as explained in detail herein and as one skilled in the art will appreciate.

SUMMARY

This section provides a general summary of the disclosure, and is not a comprehensive disclosure of its full scope or all of its features.

The present disclosure provides for a closure for closing an opening defined by a finish of a container. The closure includes a main body and a tamper band. The tamper band is connected to the main body by a plurality of bridges. A hinge of the closure is configured to permit the main body to pivot relative to the tamper band.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

FIGS. 1-6 and 18 illustrate a closure in accordance with the present disclosure; and FIGS. 7-17 illustrate an additional closure in accordance with the present disclosure.

Corresponding reference numerals indicate corresponding parts throughout the several views of the drawings.

DETAILED DESCRIPTION

Example embodiments will now be described more fully with reference to the accompanying drawings.

With initial reference to FIG. 1, a closure in accordance with the present disclosure is illustrated at reference numeral 10. The closure 10 is configured to cooperate with threads 712 of a finish 710 of any suitable container for closing an opening defined by a finish of the container (see FIGS. 13-17, for example). The closure 10 can have any suitable diameter in order to cooperate with threads 712 of any suitably sized container finish 710. For example, the closure 10 may have a diameter of 22 mm, 24 mm, 26 mm, 28 mm, 33 mm, 38 mm, or 43 mm. The closure 10 can be configured for closing a container storing any suitable commodity, such as, but not limited to, water, mineral water, light carbonation, carbonated soft drinks, juice, nitrogen dosed, or any hot-fill product. The closure 10 can be made of any suitable material, such as polypropylene, high density polyethylene, or low density polyethylene, for example.

The closure 10 generally includes a body 12 and a tamper band 20. The tamper band 20 is connected to the main body 12 by a plurality of tamper band bridges 22. The tamper band bridges 22 may be formed in any suitable manner, such as during injection molding of the closure 10 or by scoring of the tamper band 20. The tamper band bridges 22 provide small frangible areas about the tamper band 20.

The closure 10 further includes a hinge 30. The hinge 30 is configured to permit the main body 12 to be pivoted upward and off of the container finish 710 by a user while the tamper band 20 remains secured about the container finish, as explained in further detail herein and illustrated in FIG. 18, for example. The hinge 30 can be formed in any suitable manner. For example, the tamper band 20 may include scoring 32 surrounding the hinge area 30. The scoring 32 may also define the tamper bridges 22. When the closure 10 is unscrewed from a finish (such as finish 710, for example) of a container the bridges 22 break, but the hinge 30 remains intact. Once the closure 10 is rotated far enough such that closure threads 60 (see FIGS. 5 and 6, for example) of the closure 10 clear finish threads 712 of the finish 710, the main body 12 may be pivoted by a user about the hinge 30 to lift the main body 12 off of the finish 710 to permit access to the commodity stored within the container. The main body 12 may then be subsequently pivoted back down and onto the container finish 710, and the closure 10 may be screwed back onto the finish 710 to reseal the container.

Figure 2:
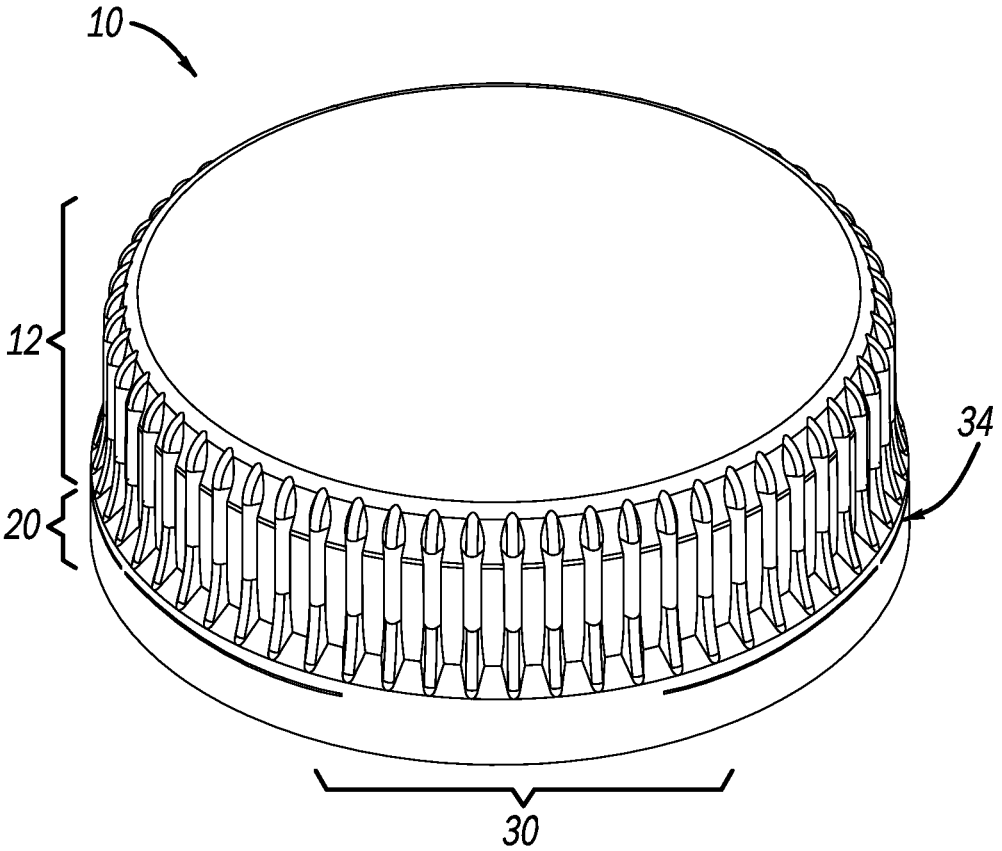
Figure 3:
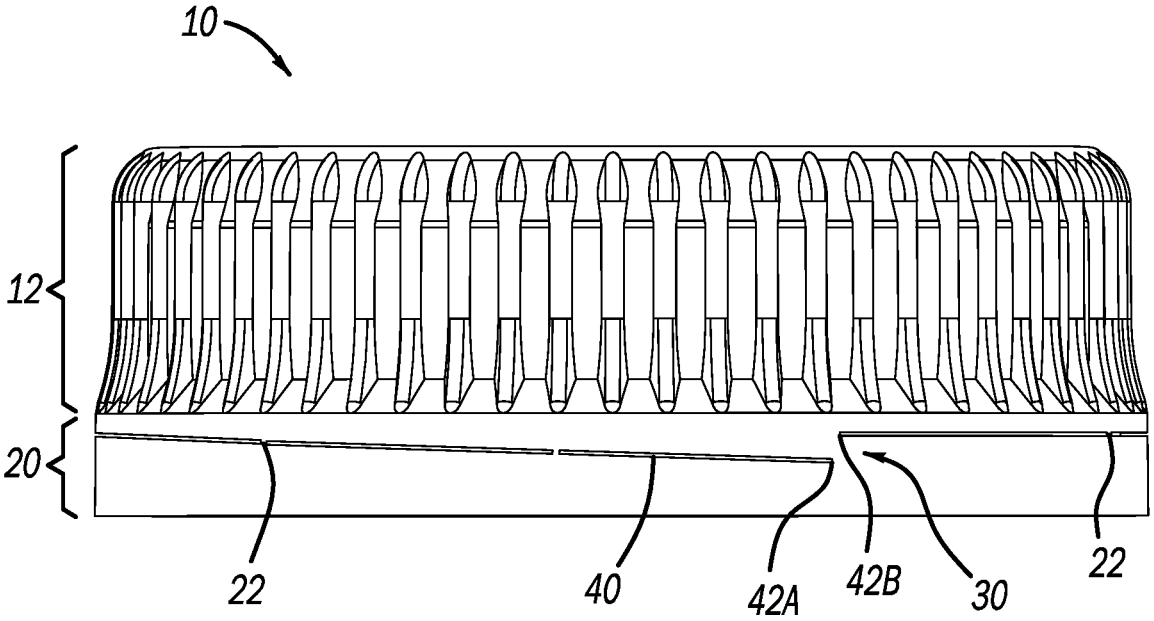

FIG. 2 illustrates an additional scoring pattern 34 in accordance with the present disclosure. The scoring pattern 34 is similar to the scoring pattern 32, but does not include vertical portions 36A and 36B (see FIG. 1) on opposite sides of the hinge 30. FIG. 3 illustrates another scoring pattern 40 in accordance with the present disclosure. The scoring 40 includes a first portion 42A, which is offset from a second portion 42B. The hinge 30 is at an area of the tamper band 20 where the first portion 42A is generally opposite to the second portion 42B.

Figure 4:
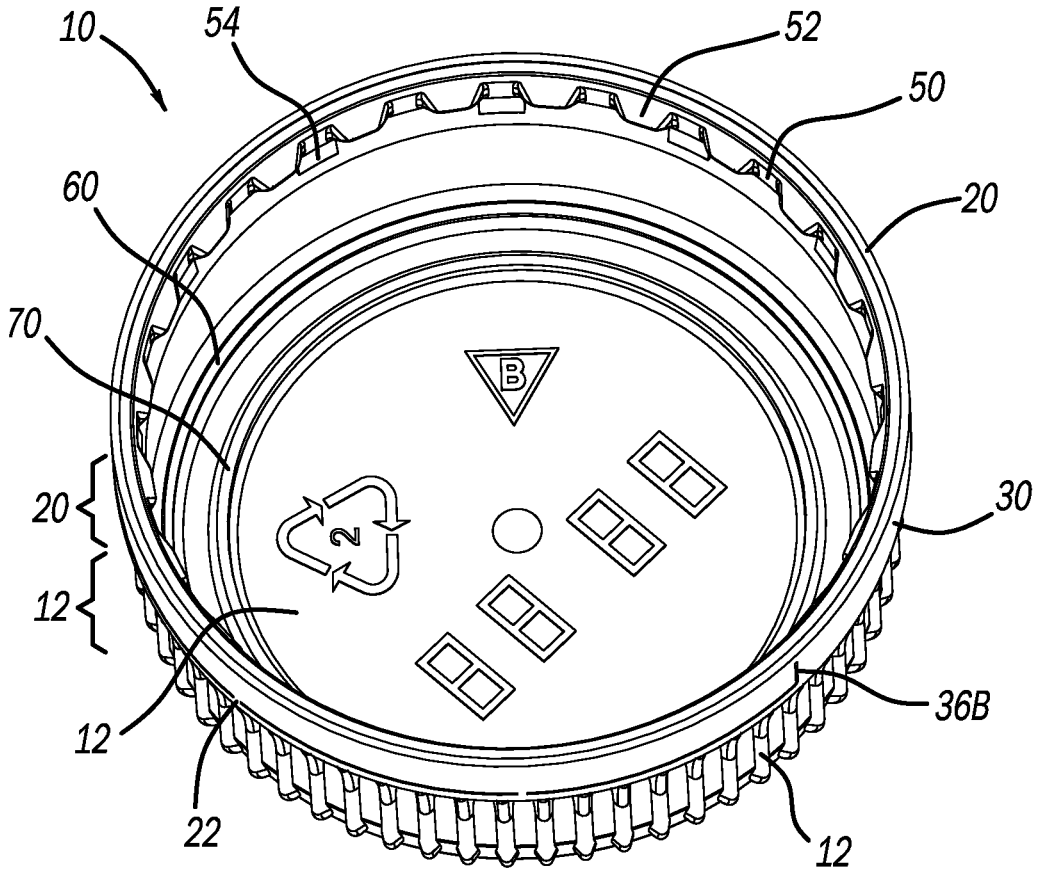
Figure 5:
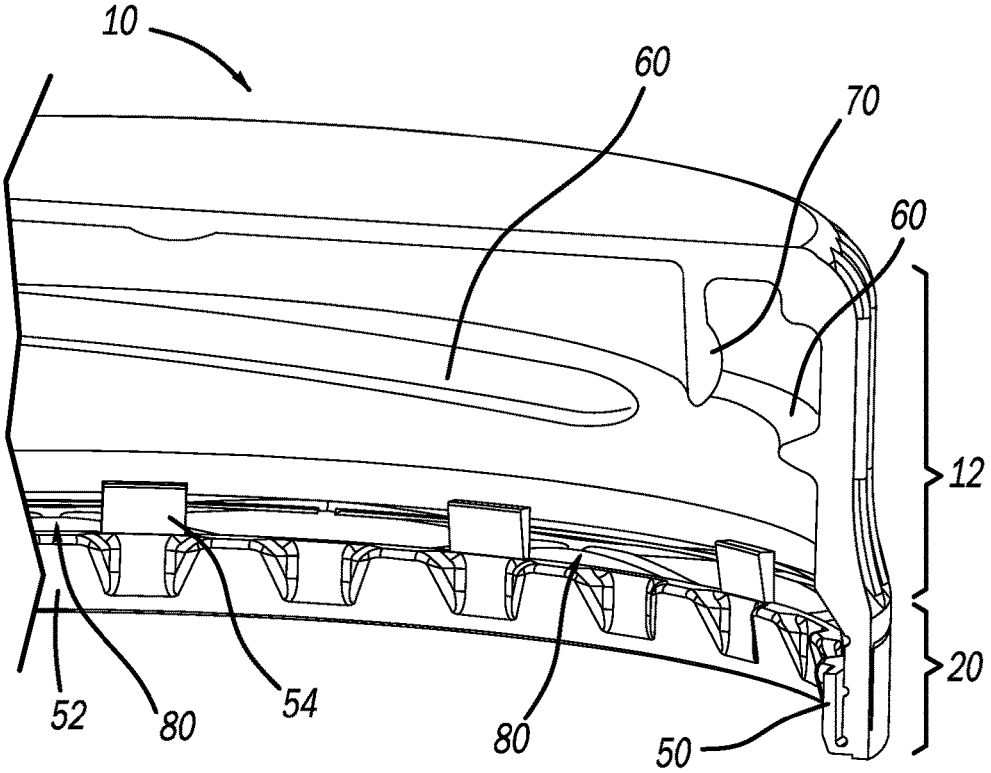
Figure 6:
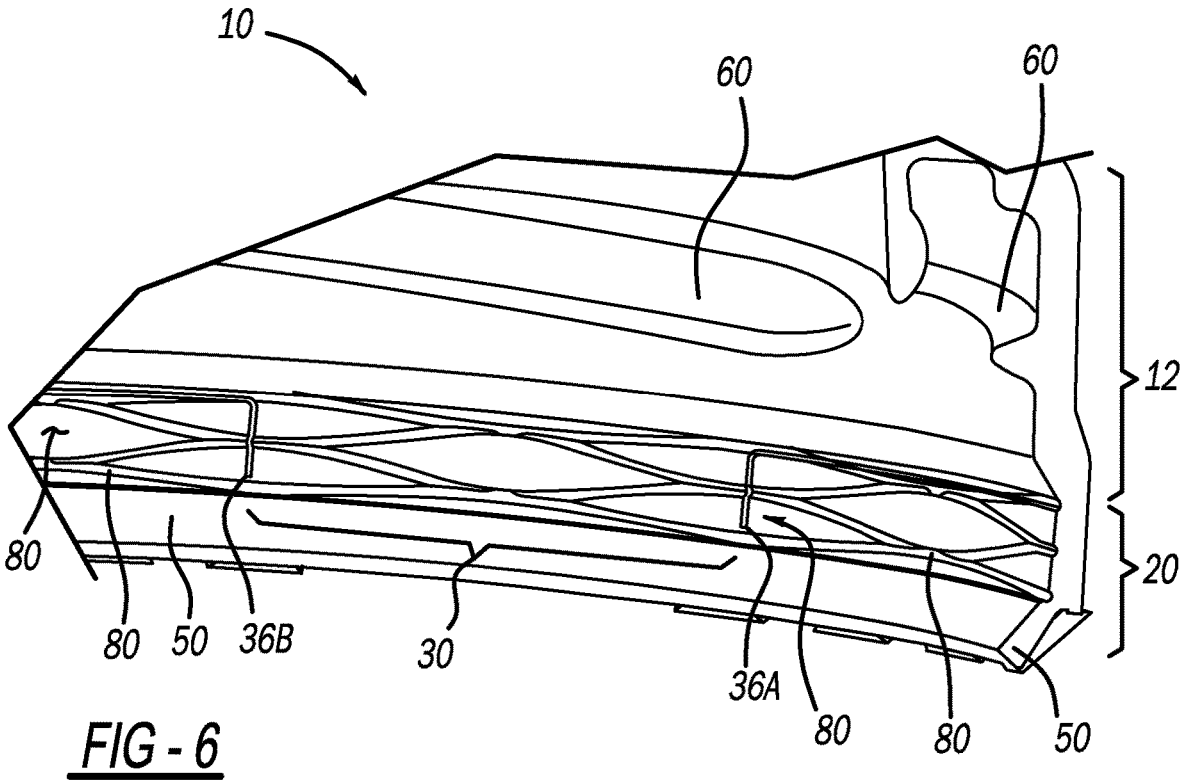

FIG. 4 illustrates an interior of the closure 10. As illustrated in FIG. 4, the tamper band 20 includes a flexible interior ring 50. The flexible interior ring 50 is movable between an outer, extended position (as illustrated in FIG. 6), and an inner, retracted position (as illustrated in FIGS. 4 and 5). The flexible interior ring 50 extends about an inner diameter of the tamper band 20. The flexible interior ring 50 includes a plurality of clips 52, which are spaced apart about the flexible interior ring 50. A plurality of tabs 54 are also spaced apart about the flexible interior ring 50. The tabs 54 are arranged between neighboring clips 52, and extend inward towards the main body 12. The tabs 54 are closer to the main body 12 than the clips 52. The clips 52 protrude from the flexible interior ring 50 inward and generally towards an axial center of the closure 10. The flexible interior ring 50 is generally formed by injection molding in the outer, extended position of FIG. 6 and inverted to the final position of FIG. 6 prior to the closure 10 being secured to the container finish during filling. As the closure 10 is secured to the finish, the flexible interior ring 50 facilitates cooperation between the clips 52 and the tabs 54 with a tamper bead 720 (see FIGS. 13 and 14, for example) in order to prevent the tamper band 20 from being removed from the finish when the closure 10 is unscrewed.

As illustrated in FIGS. 4-6, for example, the closure 10 includes a plurality of closure threads 60. The length of the closure threads 60 depends on the length of container finish threads 712, as explained herein. The closure 10 further includes an internal flange 70, which is sized, shaped, and positioned to be received within the container finish 710 and abut an interior surface of the container finish 710 to provide a seal therebetween.

With reference to FIGS. 5 and 6, the closure 10 further includes a locking structure 80 at an interior of the tamper band 20. The locking structure 80 is any suitable structural formation of the tamper band 20 that strengthens the tamper band 20 and configures the tamper band 20 and the hinge 30 such that when the main body 12 is pivoted upward off of the finish 710, the main body 12 will stay locked in the open position until the main body 12 is forced to return to its closed position. The locking structure 80 is arranged so that it extends across the hinge 30. The pattern of the locking structure 80 is configured to repeat in such a way that the closure 10 can be scored with scoring 32, 34, 40 in any orientation and still remain functional. The pattern of the locking structure 80 can be any suitable pattern, such as an oscillating wavy pattern, or any other suitable pattern that will strengthen the tamper band 20 around the hinge 30 to retain the main body 12 in the open position. The locking structure 80 operates like a cam and may lock open in more than one position such as half way open and fully open.

FIGS. 7-17 illustrate an additional closure in accordance with the present disclosure at reference numeral 510. The features of the closure 510 that are similar to, or the same as, the closure 10 are designated in the drawings with the same reference numerals, but increased by 500. The description of the similar features set forth above with respect to the closure 10 also applies to the closure 510. The closure 510 is illustrated in cooperation with finish 710. The closure 10 is configured to cooperate with the finish 710 in a similar (or the same) manner as explained above. The description of cooperation between the closure 510 and the container finish 710 also applies to the closure 10, and vice versa.

Figure 7:
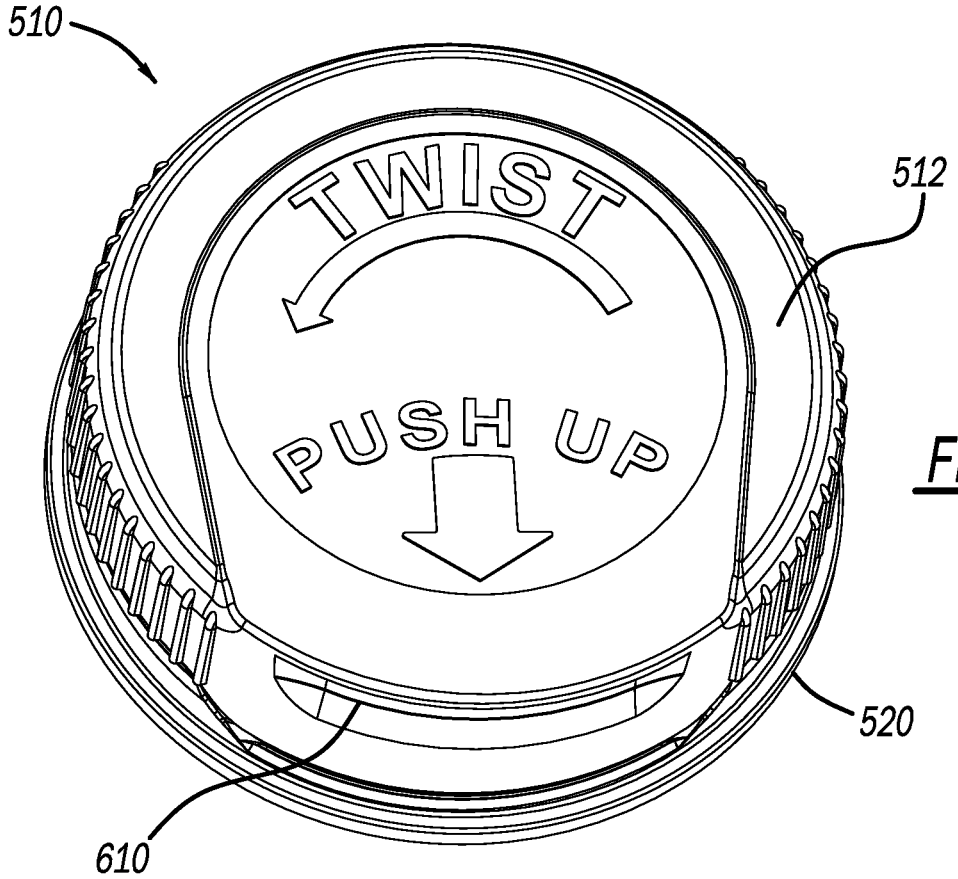
Figure 8:
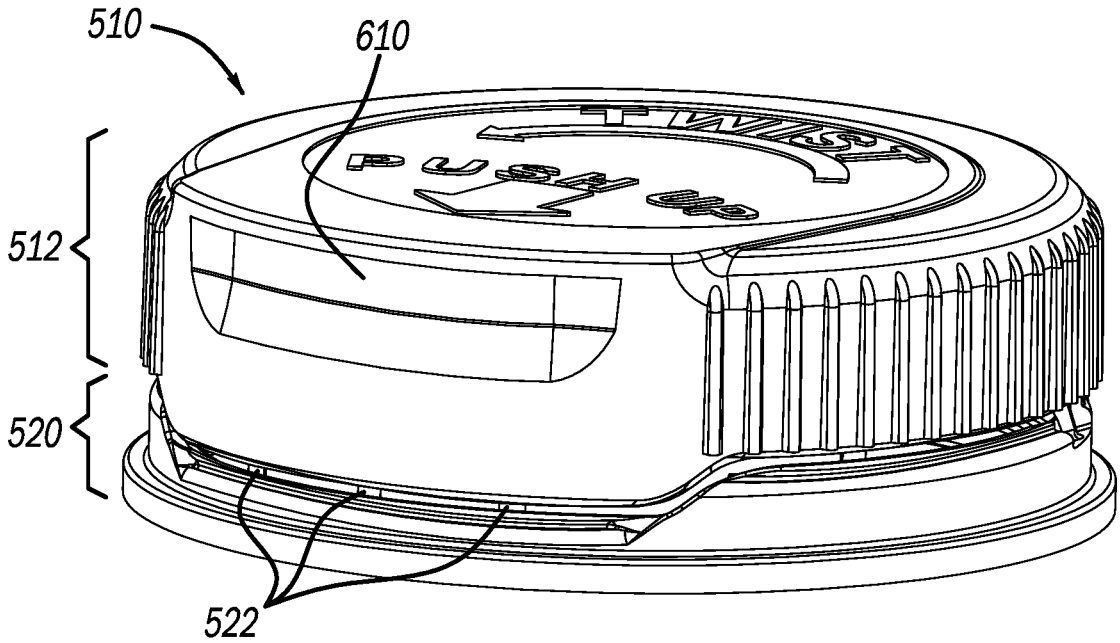
Figure 9:
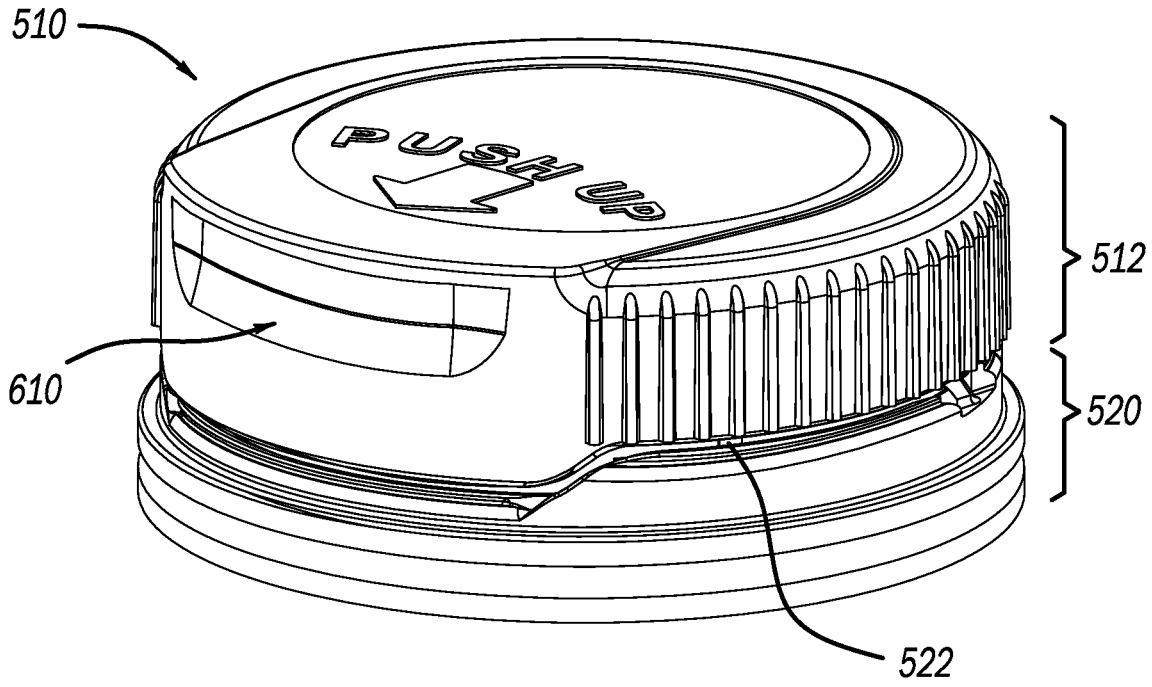
Figure 11:
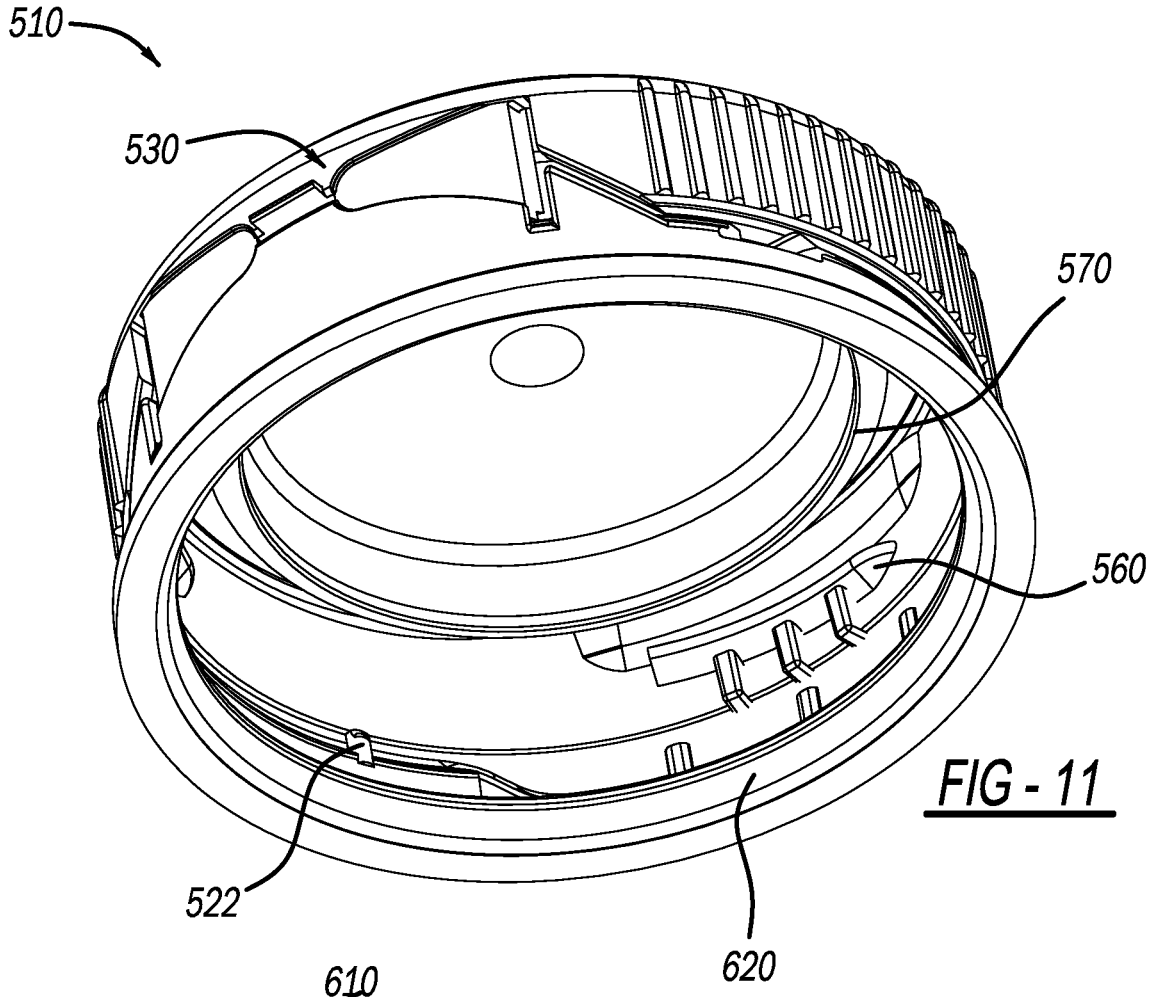
Figure 12:
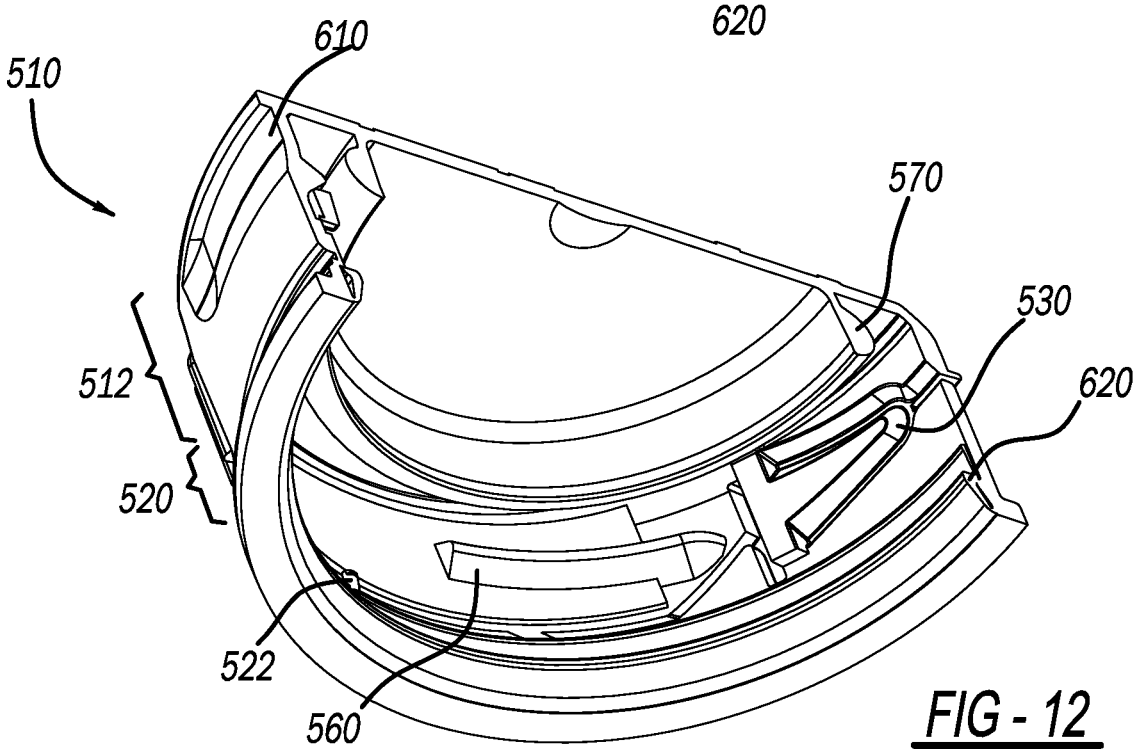
Figure 13:
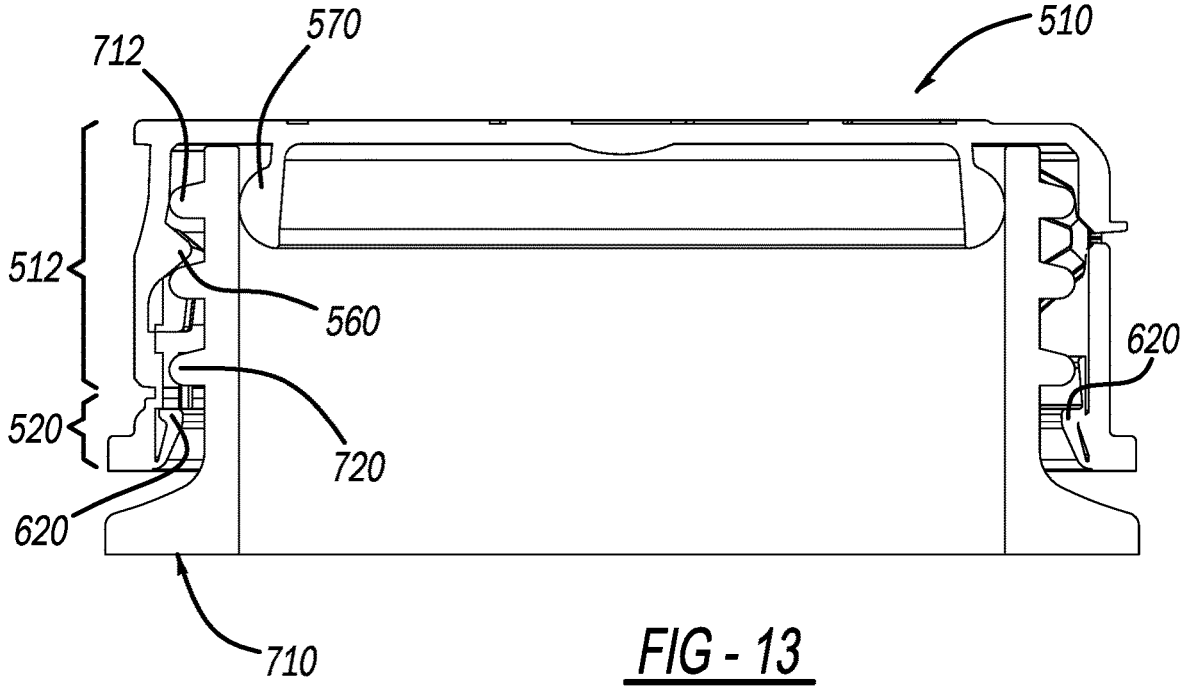
Figure 14:
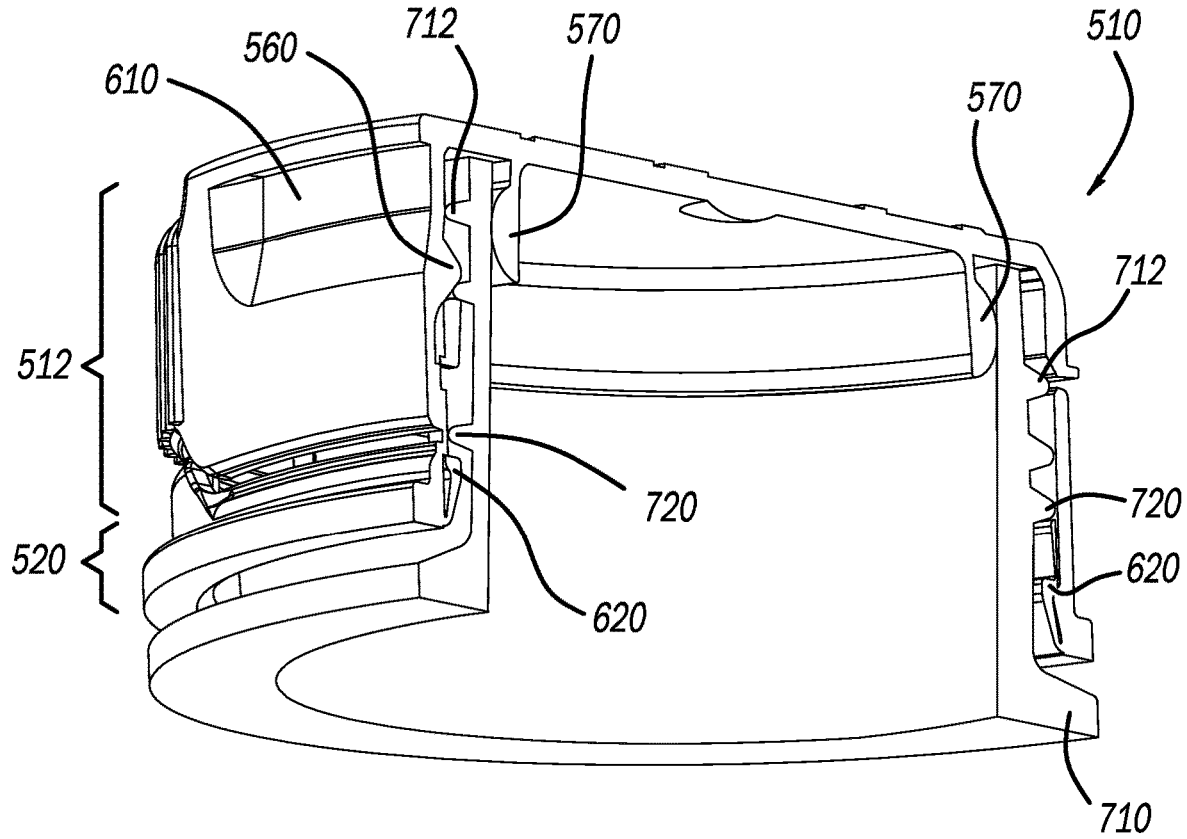
Figure 15:
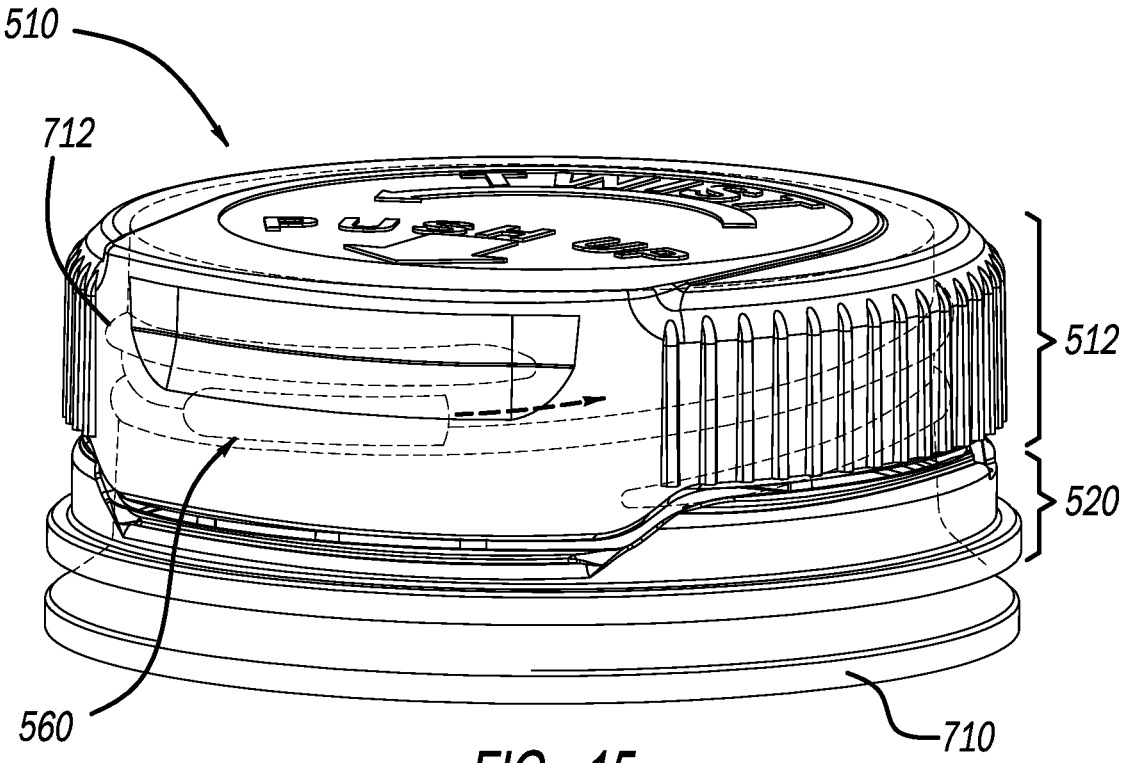
Figure 16:
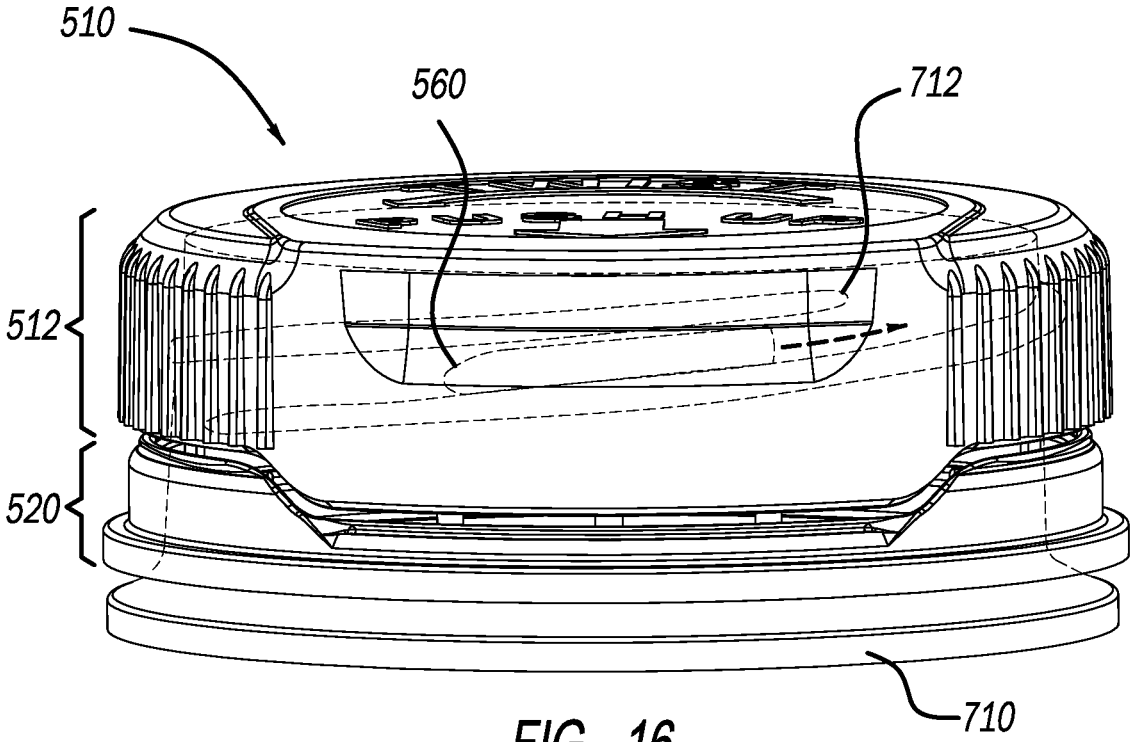

As illustrated in at least FIGS. 7-9, the closure 510 includes a thumb tab 610 at an outer surface of the main body 512. The thumb tab 610 facilitates actuation of the main body 512 between the closed position and the open position. For example, to actuate the main body 512 about the hinge 530 the user may place his or her thumb within the thumb tab 610 to pivot the main body 512 about the hinge 530. The closure 10 may include the thumb tab 610 as well. As illustrated in FIGS. 11 and 12, for example, the closure 510 includes a flexible interior ring 550 with a continuous clip surface 620. The continuous clip surface 620 abuts the tamper bead 730 as the closure 510 is unscrewed, so as to retain the tamper band 20 to the container finish 710.

Figure 10:
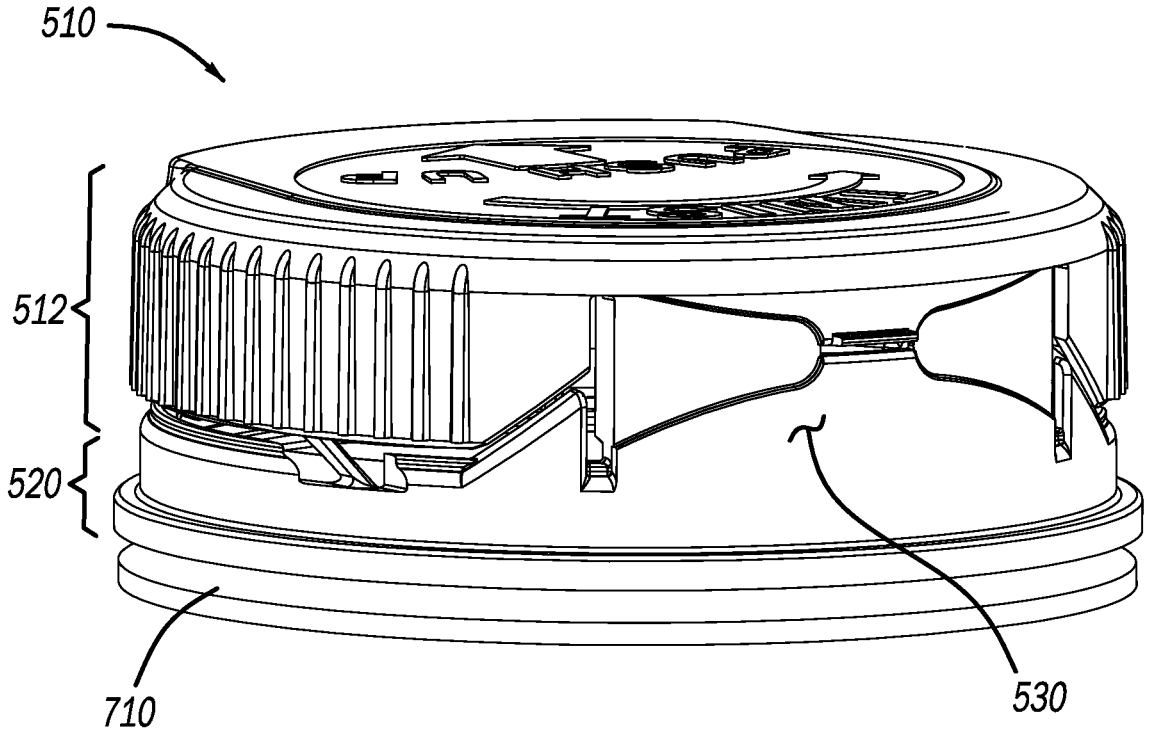
Figure 17:
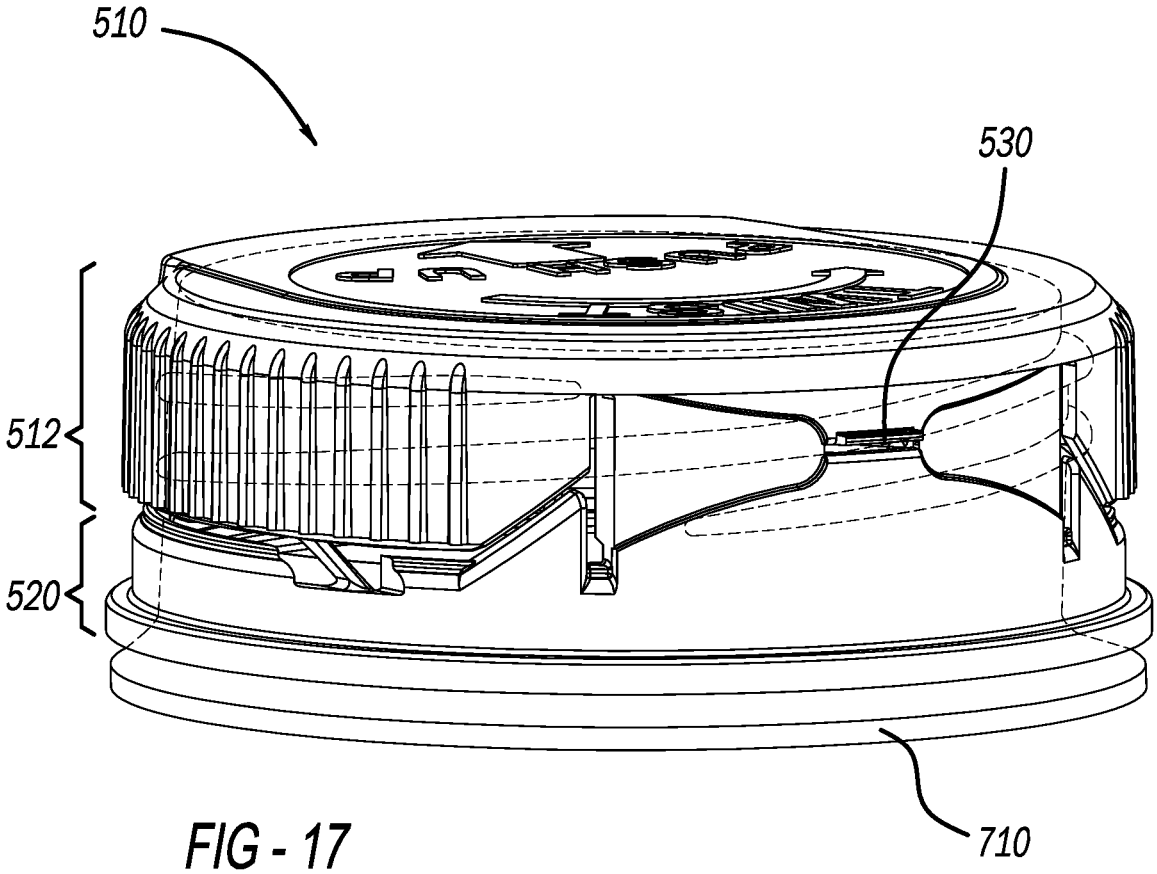
Figure 18:
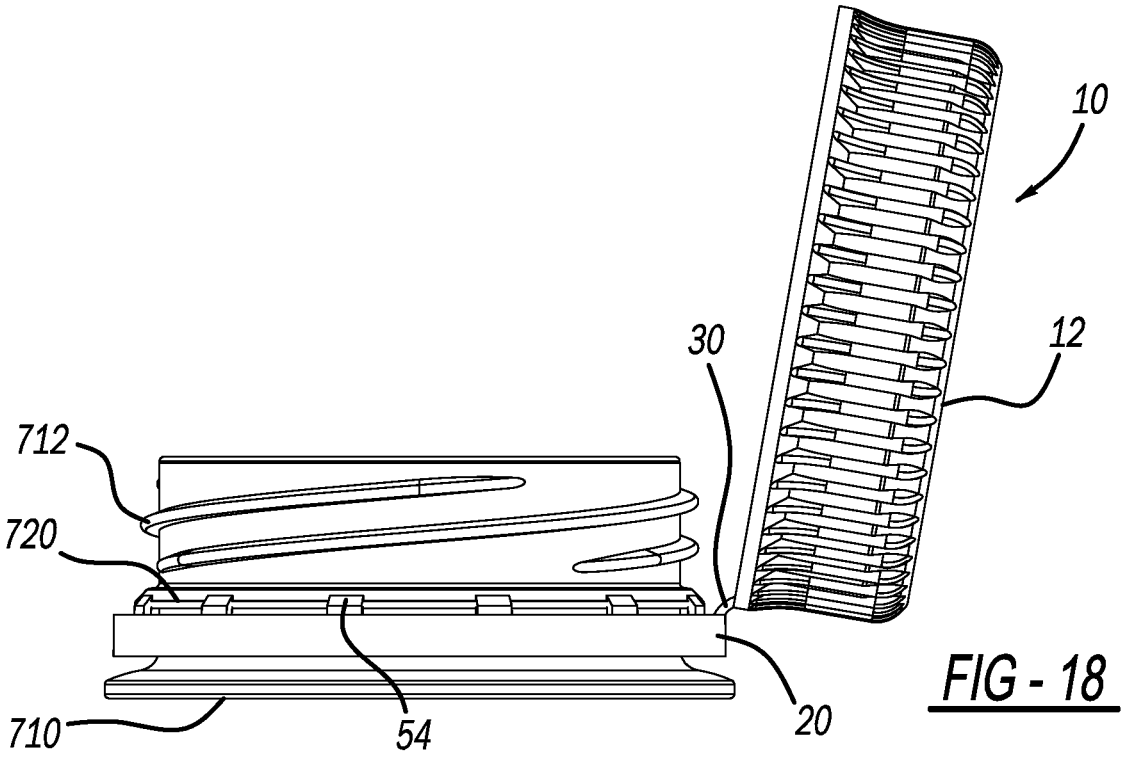

With reference to FIGS. 10 and 17, for example, the hinge 530 of the closure 510 can be a living hinge spaced apart from the tamper band 520. The living hinge 530 is formed on an outside surface of the closure 510, and is located at only one dedicated location. The location of the hinge 530 is coordinated with the location of internal closure threads 560. The closure threads 560 can be shorter than closure threads of existing closures (as are closure threads 60) so that when the closure 510 is rotated by about 30° or within the range of 20° to 180°, the closure threads 560 will clear finish threads 712 of finish 710 (see FIGS. 13-17, for example), at which point the main body 512 of the closure 510 may be pivoted upward by the user to the open position. Rotation of the closure 510 will break or weaken tamper bridges 522 (which in one embodiment are formed as part of the injection molding process instead of being scored) so that minimal force will be required to pivot the main body 512 upward. The hinge 530 is also configured to keep the closure 510 locked in the open position while dispensing. The closure 510 may be screwed back onto the container finish 710 (such as by being rotated 30° or within the range of 20 to 180°) to form a stronger seal by engaging the finish threads 712 so that the seal 570 and main body 512 cannot be accidentally disengaged or bumped open.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A closure for closing an opening defined by a finish of a container, the closure comprising:

a main body;

a tamper band connected to the main body by a plurality of bridges; and a hinge configured to permit the main body to pivot relative to the tamper band; and a locking structure extending across the hinge, the locking structure configured to maintain the main body in an open, upright position once the main body has been pivoted open at the hinge;

wherein the locking structure includes an oscillating wavy pattern axially located around an entire interior of the closure such that orientation for a scoring mechanism is not necessary and the closure can be scored anywhere rotationally to provide the hinge as a double acting hinge.

2. The closure of claim 1, wherein the tamper band includes a flexible, interior ring having a plurality of clips, the clips configured to cooperate with a tamper bead of the finish of the container to retain the tamper band to the closure subsequent to the main body being unscrewed from the finish.

3. The closure of claim 1, wherein the tamper band includes a flexible, interior ring having a continuous clip extending about the ring, the continuous clip configured to cooperate with a tamper bead of the finish of the container to retain the tamper band to the closure subsequent to the main body being unscrewed from the finish.

4. The closure of claim 1, wherein the hinge is at the main body.

5. The closure of claim 1, wherein the hinge is a living hinge.

6. The closure of claim 1, wherein the locking structure is on one of an interior or an exterior of the closure.

7. The closure of claim 1, wherein the locking structure is configured to lock in two locations.

8. The closure of claim 1, wherein the closure has a diameter of one of the following: 24 mm, 26 mm, 28 mm, 33 mm, 38 mm, and 43 mm.

9. The closure of claim 1, wherein the container is configured to retain one of the following: water, mineral water, light carbonation, carbonated soft drinks, juice, nitrogen dosed, and a hot-fill product.

10. The closure of claim 1, wherein the closure includes at least one of polypropylene, polyethylene, thermoplastic, and polymer.

11. The closure of claim 1, wherein closure threads of the closure and finish threads of the finish are configured to permit pivoting of the main body relative to the tamper band at the hinge after the closure has been rotated a predetermined amount.

12. The closure of claim 1, wherein the plurality of bridges are injection molded.

13. The closure of claim 1, wherein the plurality of bridges are scored.

14. The closure of claim 1, wherein with the closure secured to the finish of the container, subsequent to rotation of the closure a predetermined distance such that closure threads of the closure are clear of finish threads of the finish, the hinge is configured to permit pivoting of the main body relative to the tamper band to open the opening defined by the finish.

15. The closure of claim 11, wherein the predetermined amount is 30°.

16. The closure of claim 11, wherein the predetermined amount is within a range of 20° to 180°.

17. The closure of claim 11, wherein the closure is configured such that rotation of the closure the predetermined amount draws the main body and the tamper band apart to break the plurality of bridges.

18. The closure of claim 1, further comprising a thumb tab at an external surface of the main body configured to facilitate thumb actuation of the main body relative to the tamper band about the hinge.

19. The closure of claim 1, further comprising an internal flange extending from an inner surface of the main body, the internal flange position to contact an inner diameter of the finish to form a seal therebetween.

* * * * *